United States Patent [19]

Petillo, Sr.

[11] Patent Number: 4,928,336

[45] Date of Patent: May 29, 1990

[54] COMBINED INFLATABLE HEADREST AND STORAGE DEVICE

[76] Inventor: John J. Petillo, Sr., P.O. Box 47, Waretown, N.J. 08758

[21] Appl. No.: 236,854

[22] Filed: Aug. 26, 1988

[51] Int. Cl.[5] ..... A47C 20/00

[52] U.S. Cl. ..... 5/441; 5/442; 5/457

[58] Field of Search ..... 5/441, 442, 462, 434, 5/436, 437, 419, 490, 457

[56] References Cited

U.S. PATENT DOCUMENTS

| | | | |
|---|---|---|---|
| D. 273,166 | 3/1984 | Koves | 5/441 X |
| 1,950,571 | 3/1934 | Rubin | 5/442 X |
| 2,099,977 | 11/1937 | Harris . | |
| 2,522,120 | 9/1950 | Kaskey et al. | 5/436 |
| 2,612,645 | 10/1952 | Boland | 5/442 X |
| 2,792,576 | 5/1957 | Coady | 5/441 X |
| 2,857,957 | 10/1958 | Gay . | |
| 3,340,969 | 9/1967 | Rothberg | 5/441 X |
| 4,038,712 | 8/1977 | Miller | 5/452 |
| 4,272,575 | 6/1981 | Egigian | 5/417 X |
| 4,389,742 | 6/1983 | DeWitt . | |
| 4,425,675 | 1/1984 | Victor | 5/434 X |
| 4,546,507 | 10/1985 | Weinstein | 5/419 |
| 4,654,906 | 4/1987 | Roberts . | |
| 4,688,286 | 8/1987 | Miker, Jr. | 5/490 |
| 4,754,511 | 7/1988 | Sargent | 5/449 |
| 4,780,921 | 11/1988 | Lahn et al. | 5/490 |
| 4,815,154 | 3/1989 | Grimes | 5/490 |

FOREIGN PATENT DOCUMENTS

| | | | |
|---|---|---|---|
| 1314885 | 12/1962 | France | 5/434 |

*Primary Examiner*—Gary L. Smith
*Assistant Examiner*—Michael J. Milano
*Attorney, Agent, or Firm*—Fleit, Jacobson, Cohn, Price, Holman & Stern

[57] ABSTRACT

An inflatable headrest and storage device having a base forming a storage compartment located below a generally rectangular headrest. The base is provided with an access opening to receive articles to be stored or sand to anchor the headrest in place. The headrest includes an arcuate top wall and an inflation valve for mouth inflation of the headrest. The entire structure is manufactured from heavy duty vinyl plastic material to enable it to be folded into a compact condition when uninflated and when all material and objects have been removed from the base.

1 Claim, 1 Drawing Sheet

COMBINED INFLATABLE HEADREST AND STORAGE DEVICE

BACKGROUND OF THE INVENTION

1. Field of the Invention

The present invention generally relates to a headrest especially adapted for use by individuals at the beach, at lakeshore or in any other location in which it is desired to have a portable and readily available headrest. The headrest includes an inflatable compartment with an inflation valve associated therewith and a base separate from the inflatable compartment having a slit or zipper closure for receiving personal articles or receiving sand in order to provide a storage area and to anchor the headrest in place when high wind conditions occur. The headrest and storage device provides a comfortable headrest that can be adjusted to the individual desires of a user and a storage area for valuables and personal items all of which can be collapsed into a compact condition for easy storage such as in a purse, the glove compartment of an automotive vehicle and the like.

2. Description of the Prior Art

Various efforts have been made to enhance the comfort of individuals at the beach or other recreational areas when reclining on blankets or other supporting surfaces in order to effectively support the head generally in the nature of a pillow. Another problem which exists when at the beach is the storage of valuables such as wallets, suntan lotion and other personal items. Also, high wind conditions frequently are encountered at the beach and various blankets and the like are subject to being dislodged and blown to other locations by the wind. While pillows and rolled up towels are frequently used as a headrest, there is no effective arrangement to provide adequate headrest support customized to the individual user and at the same time provide storage areas for valuables, personal items and the like and also provide for stabilizing and securing the headrest in position and also capable of being folded into a compact condition for storage.

SUMMARY OF THE INVENTION

An object of the present invention is to provide a headrest having a compartment arrangement with an inflation valve which enable inflation by mouth to a desired pressure depending upon the individual requirements of each user.

Another object of the invention is to provide a headrest in accordance with the preceding object having a separate base with an opening therein in a vertical peripheral edge thereof to enable storage of various valuables, personal items and the like with the opening being either a slit-like opening or an opening provided with a closure device such as a zipper to protect and store the items positioned therein.

A further object of the invention is to provide a headrest in accordance with the preceding objects in which the base of the inflatable headrest also is capable of receiving sand in order to further serve as an anchor for the headrest so that it will not be blown off the blanket or blown away by high wind from the area in which it is used.

Still another object of the invention is to provide a headrest and storage device which is constructed of flexible material which enables it to be collapsed and folded into compact condition for ease of storage.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
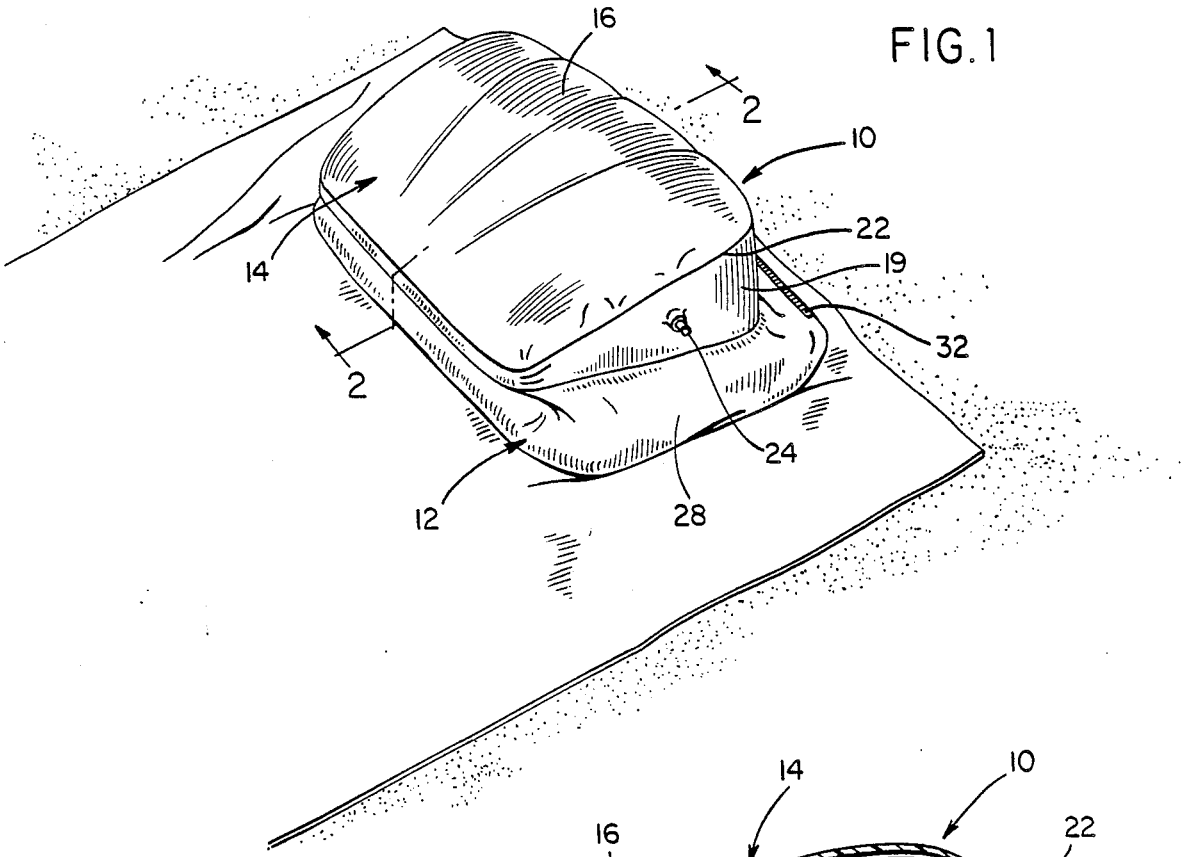
FIG. 1 is a perspective view of the inflatable headrest and storage device of the present invention.
Figure 2:
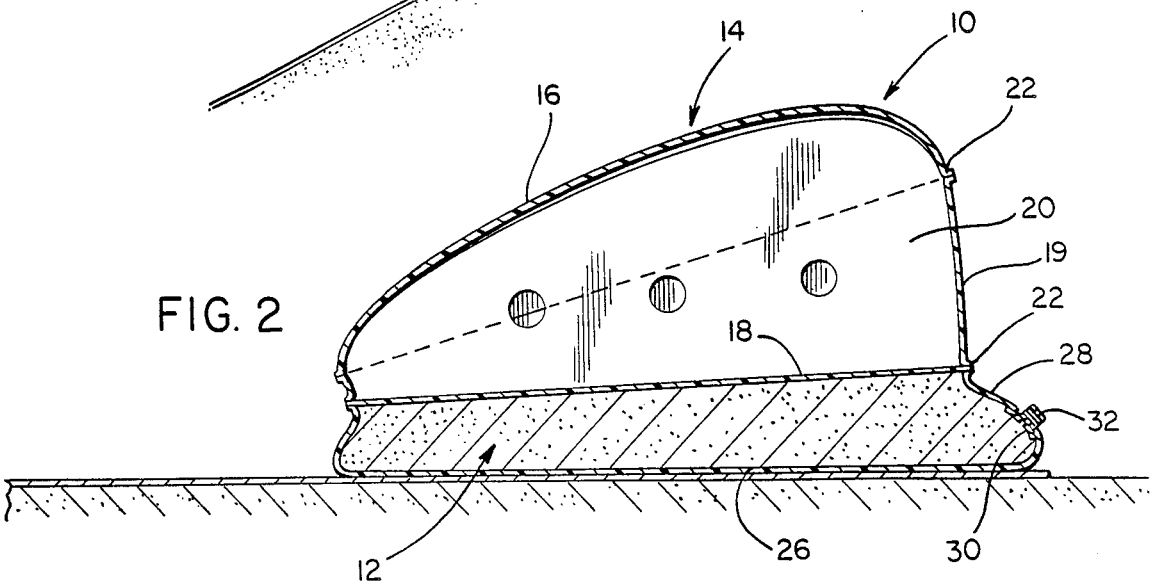
FIG. 2 is a transverse, sectional view of the construction of FIG. 1 taken substantially upon a plane passing along section line 2—2 on FIG. 1.
Figure 3:
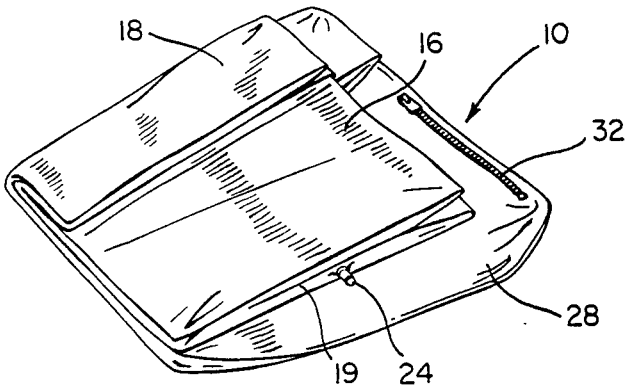
FIG. 3 is a perspective view of the headrest and storage device of the present invention illustrating it in folded or collapsed position ready for storage in a small area.

Referring now specifically to the drawings, the headrest and storage device of the present invention is generally designated by reference numeral 10 and includes a storage base 12 and an inflated compartment forming a headrest or pillow 14.

The headrest or pillow 14 is formed by an arcuate top wall 16 and a bottom wall 18 which are interconnected by a peripheral side wall 19 and a of partitions 20 which stabilize and join the top wall 16 to the bottom wall 18. These compartments are constructed of flexible material with the peripheral edges of the top wall 16, the side wall 19 and the bottom wall 18 being secured together by heat sealing or by any other means as indicated by the numeral 22. Preferably, the top wall 16, side wall 19, partitions 20 and bottom wall 18 are all constructed of vinyl plastic material of any desired thickness and strength characteristics and of any desired color. An inflation valve 24 is provided in the side wall 19 at one end of the headrest 14 with the valve 24 being the type that enables mouth inflation of the headrest 14. When inflated, the headrest 14 is generally rectangular and provided with an arcuate top surface and parallel side and end edges having a dimension which will fully support the head of a person when resting on the headrest. The degree of inflation may vary so that the pressure within the headrest will provide whatever degree of support is desired by individual users so that the individual users will be comfortably supported when their head is supported by the headrest.

The base 12 includes a bottom wall 26 which is spaced from the bottom wall 18 of the headrest and also includes a peripheral wall 28 which produces a compartment above the bottom wall 26 which is provided with access through a horizontal slit 30 at the rear edge thereof which is provided with a zipper closure 32 so that when the zipper closure 32 is opened, the compartment formed by the bottom wall 26 and peripheral wall 28 can be used as a storage area for personal or valuable items such as suntan lotion, wallets, keys, tissues and the like. The items stored in the base 12 will serve as an anchor for the headrest but yet enable the headrest to be moved when desired. In certain instances, the base 12 may be used for receiving sand in order to more thoroughly anchor the headrest in place. The sand can merely be scooped into the hollow base area in a conventional manner and dumped therefrom when desired.

Inasmuch as the entire structure of the headrest is constructed of vinyl material, the headrest can be deflated and any material in the base whether it be personal items, valuables or sand can be removed and the entire headrest folded into a compact condition for storage in a small area such as in the glove compartment, trunk or the like of an automotive vehicle or in the purse of a user.

The entire device may have a size of approximately 20" in width and 30" in length and is generally of rectangular configuration and constructed of heavy duty vinyl. The device is especially useful by individuals at the beach, alongside pools, lakes, at picnics and other outdoor activities. The structure enables the device to be easily stored and depending upon the wind conditions, the device is effective without using sand and the variation in the inflation pressure enables the overall elevation of the headresting surface to be varied and also enables the softness or hardness of the headrest to be varied by varying the pressure in accordance with the individual desires of the various users. Even if personal items or valuables are placed in the base or if sand is placed therein, it will not affect the comfort of the person using the headrest since the inflatable headrest compartment above the base will preclude contact between the head and the items within the base. The partitions 20 stabilize the arcuate top wall 16 by limiting the upward movement thereof regardless of the inflation pressure and maintaining the contour of the upper surface of the headrest adjacent the area which is engaged by the head of a user.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A headrest for use at the beach by a user in reclined position, said headrest comprising a storage base and an inflatable compartment, said inflatable compartment including a bottom wall of generally rectangular configuration, a top wall overlying said bottom wall, a peripheral side wall interconnecting the periphery of the bottom wall and top wall, said top wall being generally rectangular and slightly larger than the bottom wall, a plurality of partitions interconnecting the top wall and bottom wall, each of said partitions having a straight lower edge and an arcuate upper edge, and an inflation valve in said side wall to inflate the compartment into a generally rectangular pillow having a convex upper surface, said side wall including elongated portions forming the sides of the pillow and shorter portions forming the ends of the pillow, one of said elongated portions having a greater vertical height than the other, said shorter portions including an inclined upper edge extending between the upper edges of the elongated portions thereby orienting the top wall of the pillow in inclined relation to the bottom wall, said storage base including a bottom wall spaced below the bottom wall of the inflatable compartment, a peripheral side wall interconnecting said bottom walls to form a storage compartment, said storage base side wall including an elongated slit opening therein spaced from said bottom walls and generally parallel to the bottom walls, and closure means for closing said slit opening to enable the storage of articles therein and positioning of sand therein to serve as an anchor for the headrest at the beach when windy conditions are encountered, all of the walls and partitions forming the headrest being constructed of flexible vinyl material sealed together to enable the headrest to be folded into compact condition when not inflated and the storage base is empty.

* * * * *